US005405739A

United States Patent [19]

Ohya et al.

[11] Patent Number: 5,405,739

[45] Date of Patent: * Apr. 11, 1995

[54] SILVER HALIDE PHOTOGRAPHIC LIGHT-SENSITIVE MATERIAL

[75] Inventors: Yukio Ohya; Masato Okuyama, both of Odawara, Japan

[73] Assignee: Konica Corporation, Japan

[ * ] Notice: The portion of the term of this patent subsequent to Sep. 21, 2010 has been disclaimed.

[21] Appl. No.: 146,522

[22] Filed: Nov. 1, 1993

[30] Foreign Application Priority Data

Nov. 13, 1992 [JP] Japan ..... 4-303897

[51] Int. Cl.[6] ..... G03C 1/08

[52] U.S. Cl. ..... 430/600; 430/576; 430/583; 430/584; 430/585; 430/586; 430/588; 430/604; 430/605

[58] Field of Search ..... 430/601, 611, 614, 576, 430/583, 584, 585, 586, 588, 604, 605

[56] References Cited

U.S. PATENT DOCUMENTS

| | | | |
|---|---|---|---|
| 3,062,046 | 11/1962 | Dann et al. | 430/600 |
| 3,271,157 | 9/1966 | McBride | 96/197 |
| 3,930,867 | 1/1976 | Bigelow | 430/600 |
| 4,269,927 | 5/1981 | Atwell | 430/217 |
| 5,169,751 | 12/1992 | Szücs et al. | 430/600 |
| 5,246,828 | 9/1943 | Okuyama et al. | 430/584 |
| 5,252,454 | 10/1993 | Suzumoto et al. | 430/572 |

FOREIGN PATENT DOCUMENTS

| | | |
|---|---|---|
| 2461919 | 7/1975 | Germany . |
| 4100567 | 7/1991 | Germany . |

*Primary Examiner*—Thorl Chea

*Attorney, Agent, or Firm*—Jordan B. Bierman; Bierman and Muserlian

[57] ABSTRACT

A silver halide photographic light-sensitive material comprises a support and provided thereon, a silver halide emulsion layer containing silver halide grains and a macrocyclic compound in an amount of $1\times10^{-6}$ to $1\times10^{-1}$ mol per mol of silver, said macrocyclic compound comprising a 9- or more-membered ring containing at least one of a nitrogen atom, an oxygen atom, a sulfur atom and a selenium atom, and said silver halide grains having a silver chloride content of not less than 90 mol % and containing at least one metal selected from the group consisting of metals of VIB group, VIIB group, VIII group, IIB group, IIIA group and IVA group from the Periodic Table.

7 Claims, No Drawings

SILVER HALIDE PHOTOGRAPHIC LIGHT-SENSITIVE MATERIAL

FIELD OF THE INVENTION

The present invention relates to a silver halide photographic light-sensitive material, more particularly to a high-speed silver halide photographic light-sensitive material excellent in sensitivity fluctuation caused by long term storage of a raw product.

BACKGROUND OF THE INVENTION

Recently, in order to finish a large amount of prints in a short delivery time, light-sensitive materials for color photographic papers to be improved in terms of rapid processing have been demanded. As one of the methods for attaining this, a method to use silver chloride emulsions or silver bromochloride emulsion having a high silver chloride content for enhancing processing speed has been known. However, it has been known that silver chloride emulsions or silver bromochloride emulsions having a high silver chloride content have a low sensitivity.

As a method for enhancing sensitivity, it is known that a super sensitization method is useful. Super sensitization is described in Photographic Science and Engineering, Volume 13, pp. 13–17 (1969) and Volume 18, pp. 418–430 (1974) and The Theory of the Photographic Process 4th edition, page 259, published by MacMillan Inc., 1977. It is known that, by selecting suitable sensitizing dyes and super sensitizers, high sensitivity can be obtained.

Heretofore, many compounds such as stylbene, azaindene, mercaptoheterocycles, thiourea and condensed compounds between phenol and hexamethylenetetraamine have been known as a super sensitizer. For example, they are disclosed in U.S. Pat. Nos. 2,875,058, 3,340,064, 3,457,078, 3,458,318, 3,615,632, 3,695,888 and 4,011,083 and Japanese Patent Publication Open to Public Inspection (hereinafter referred to as "Japanese Patent OPI Publication") No. 203447/1986. However, it was discovered that, when a silver halide emulsion is subjected to super sensitization by the use of the above-mentioned conventional technology, increase in sensitivity is still insufficient, and that fluctuation in photographic sensitivity is noticeable after storage of raw products.

Storage stability of photographic light-sensitive materials is extremely critical for preventing deterioration in quality of the print finish. Therefore, the above-mentioned technologies are not practically desirable.

In Japanese Patent O.P.I. Publication No. 100048/1990, technology to incorporate crown ethers and cyclodextrine into silver halide light-sensitive materials as a coagulation-destroying compound for magenta dyes is disclosed. However, the object of this technology is to improve stability of magenta dye, and no suggestion is given with regard to super sensitization effects of the above-mentioned compounds.

Japanese Patent O.P.I. Publication No. 25833 discloses that tetrazole derivatives having a cyclic structure which serves as a chelating agent in a molecule provide super sensitization to silver bromide emulsions. However, there is no description in it about super sensitization effects to silver chloride or silver-chloride-rich silver bromochloride. In addition, there is no description about super sensitization effects on silver halide emulsions containing metal ions.

In Japanese Patent O.P.I. Publication Nos. 13923/1976 and 171947/1984, technology to enhance sensitivity by incorporating products of metal from VIII group into silver halide grains is disclosed. In addition, in U.S. Pat. No. 4,269,927, technology to enhance sensitivity by incorporating cadmium, zinc, copper and lead into silver halide grains having a silver chloride content ratio of 80 mol % or more is disclosed. In Japanese Patent O.P.I. Publication Nos. 20853/1990 and 20854/1990, technology to enhance sensitivity by incorporating a 6th-seat ligand complex having cyano ligand of rhenium, ruthenium osmium or iridium. However, in the above-mentioned methods, increase in sensitivity is insufficient so that additional enhancement of sensitivity has been demanded.

SUMMARY OF THE INVENTION

Accordingly, an object of the present invention is to provide a high-speed silver halide photographic light-sensitive material excellent in sensitivity fluctuation caused by long term storage of a raw product.

DETAILED DESCRIPTION OF THE INVENTION

The above-mentioned object of the present invention was attained by a silver halide photographic light-sensitive material comprising a support having thereon at least one light-sensitive emulsion layer containing a silver halide emulsion, wherein said light-sensitive emulsion layer mainly comprises a silver halide grain containing silver chloride in an amount of 90 mol % or more and at least one kind of metal ion selected from the following metals, and also comprises a macrocyclic compound containing a hetero-atom.

Metals : VIB group, VIIB group, VIII group, IIB group, IIIA group and IVA group from the periodic table.

Hereunder, the present invention will be explained in detail.

In silver halide photographic light-sensitive materials of the present invention, the silver halide grains of the present invention are silver bromochloride grains containing silver chloride in an amount of 90 mol % or more or silver chloride grains each containing no silver iodide substantially. When silver iodide is not contained substantially, the content of silver iodide is not more than 0.5 mol %, preferably not more than 0.1 mol % and more preferably zero. In addition, silver chloride content is preferably not less than 95 mol %, more preferably not less than 98 mol % and most preferably not less than 99 mol %.

When silver halide grains of the present invention are silver bromochloride containing silver bromide, they may be core/shell grains wherein the components of core and shell are different each other in each silver halide grains or grains having localized phase of silver bromide on the surface or inside thereof. The preferable is a silver halide grain having uniform composition throughout a grain from inside to the surface thereof.

In the present invention, at least one kind of metal salt or metal complex salt selected from the following metals are used in combination.

Metals : VIB group, VIIB group, VIII group, IIB group, IIIA group and IVA group from the periodic table.

Of the above-mentioned metals, the preferable are Fin, Fe, Co, Ni, Zn, Ga, Ge, Mo, Ru, Pd, Cd, In, Sn, W, Re, Os, Ir, Pt, Tl, Pb and Zn. The especially preferable are Fe, Ru, Pd, Re, Os, Ir, Pt, Ga, Ge, In and Tl.

The above-mentioned metals are used in the form of salt or complex salt.

Hereunder, practical examples thereof are cited. However, the present invention is not limited thereto.

Manganese chloride, red prussiate, yellow prussiate, ferrous thiocyanate, ferric thiocyanate, ferrous chloride, ferric chloride, cobalt chloride, cobalt nitrate, nickel chloride, zinc chloride, potassium nitrate, germanium nitrate, molybdenum chloride, indium chloride, tin chloride, tungsten chloride, potassium hexacyano rhenium acid, rhenium chloride, potassium hexacyanoosmium, osmium chloride, potassium tetracyano platinic acid, thallium chloride, lead nitrate, iridium chloride (III), iridium bromide (III), iridium chloride (IV), potassium hexachloroiridium, potassium hexacyanoiridium, hexaanmine iridium salt and trioxalato iridium are cited.

In the present invention, any of the above-mentioned metals may be used for combination. It is preferred that iridium compounds are used for at least one of them.

Iridium compounds are 3-valent or 4-valent salts or complex salts. Typical ones are shown above.

The amount of an iridium compound used is $1\times10^{-11}$ to $5\times10^{-5}$ mol and preferably $1\times10^{-10}$ to $5\times10^{-6}$ mol per mol of silver.

The amount of using the above-mentioned metal salts or metal complex salts other than iridium is $1\times10^{-7}$ to $1\times10^{-3}$ mol and preferably $1\times10^{-6}$ to $1\times10^{-4}$ mol per mol of silver.

In the present invention, all at least one kind of metal salts or metal complex salts selected from metals of the present invention (hereinafter referred to as a dopant of the present invention) is needed is that it is incorporated in silver halide grains. It may be localized or distributed uniformly inside the grain.

In the present invention, a silver halide grain is formed in the presence of a dopant of the present invention to contain the do pant therein.

Next, the macrocyclic compound of the present invention used as a super sensitizer will be explained. The macrocyclic compound including a hetero-atom in the present invention is a compound comprising a 9- or more-membered ring containing at least one of a nitrogen atom, an oxygen atom, a sulfur atom and a selenium atom as a hetero-atom.

A macrocyclic compound having an aromatic ring is preferred, and the macrocyclic compound represented by the following Formula (1) is more preferred.

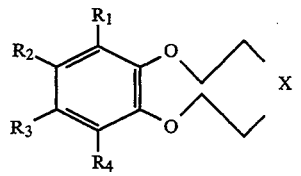

Formula (1)

wherein $R_1$, $R_2$, $R_3$, and $R_4$ independently represent a hydrogen atom, an alkyl group, an alkoxy group, an aryl group, an aryloxy group, an alkenyl group, an alkenyloxy group, an acyl amino group, a halogen atom, an alkylthio group, an arylthio group, an alkoxycarbonyl group, an acyloxy group, an acyl group or a sulfonamido group, provided that two of $R_1$ to $R_4$ may combine to form a 5- or 6-membered ring; and X represents a divalent group containing an oxygen atom or a nitrogen atom.

Typical compounds include crown ethers. Since the below-mentioned Pedersen synthesized them in 1967 and reported their specific characteristics, many compounds have been synthesized. They are described in detail in C. J. Pedersen, Journal of American chemical Society, vol. 86 (2495), 7017–7036 (1967), G. W. Gokel, S. H. Korzeniowski, "Macrocyclic polyether synthesis", Springer-Verlag. (1982), "Chemistry of crown ether" edited by Oda, Shono and Tabuse, Kagaku Dojin (1978), "Host-Guest" edited by Tabuse, Kyoritsu Shuppan (1979) and "Organic synthetic chemistry" edited by Sasaki and Koga, vol. 45 (6), pp. 571–582 (1987). Hereunder, practical examples of macrocyclic compounds containing hetero-atoms used in the present invention are illustrated. However, the present invention is not limited thereto.

S-1

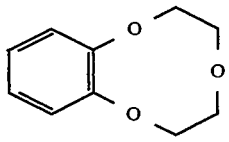

S-2

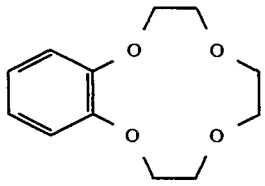

S-3

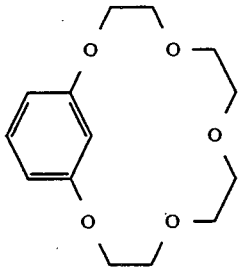

S-4

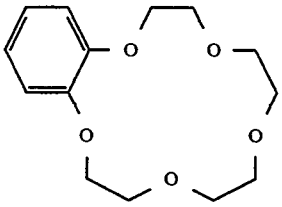

-continued
S-5
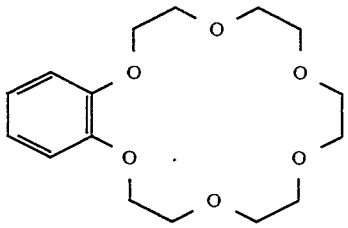
S-6
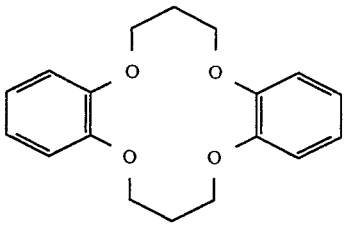
S-7
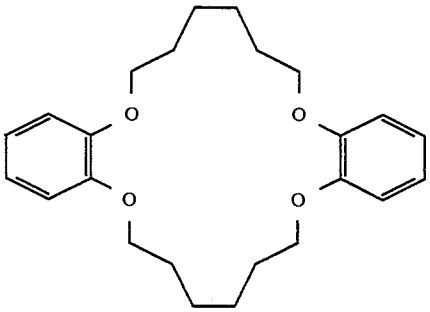
S-8
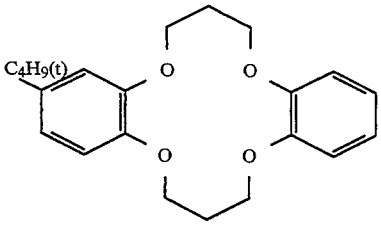
S-9
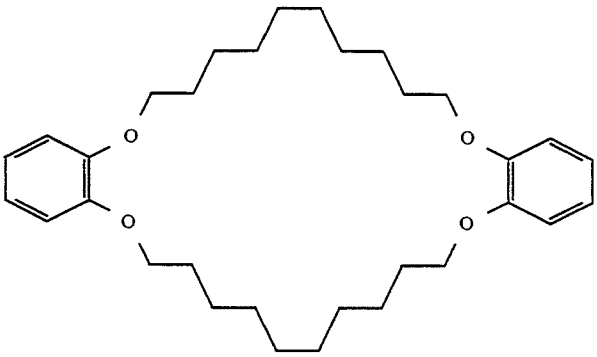
S-10
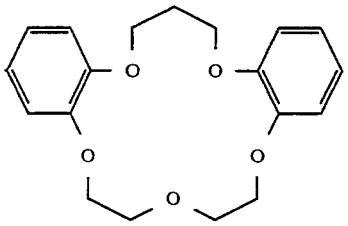
S-11
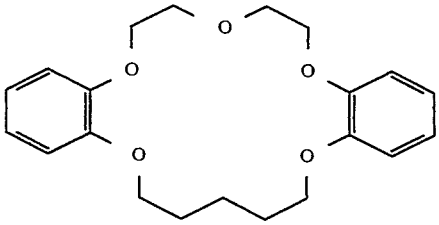
S-12
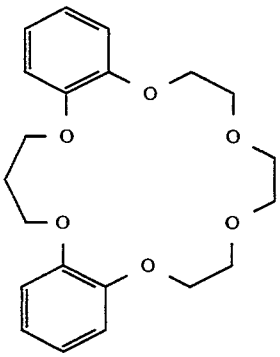
S-13
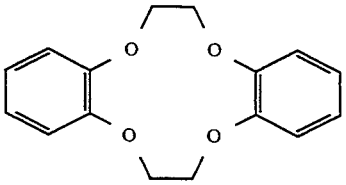

-continued
S-14
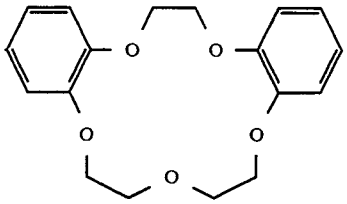
S-15
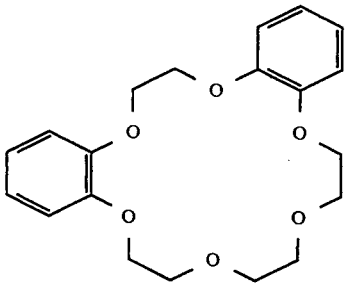
S-16
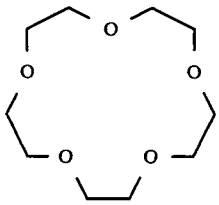
S-17
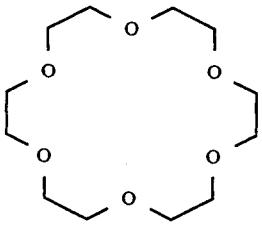
S-18
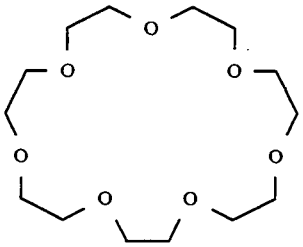
S-19
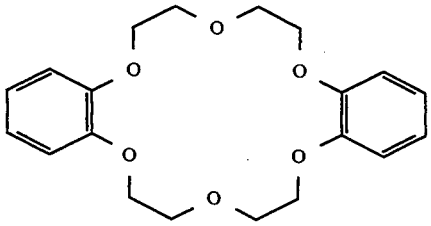
S-20
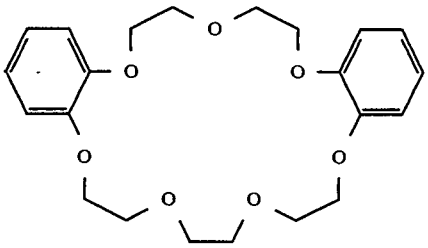
S-21
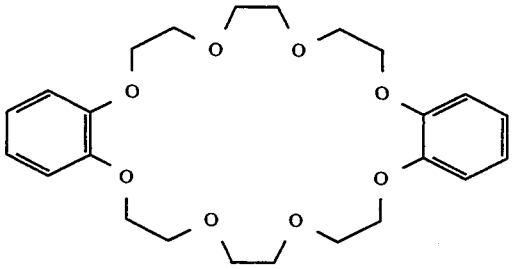
S-22
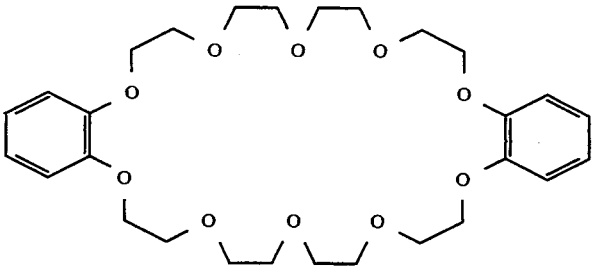
S-23
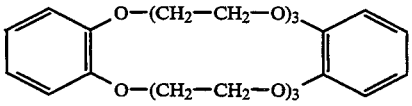
S-24
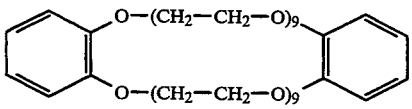

-continued
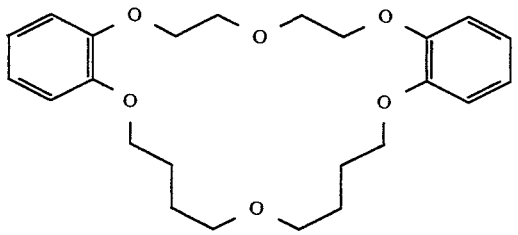
S-25
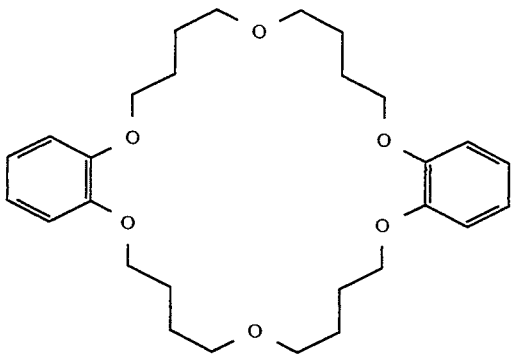
S-26
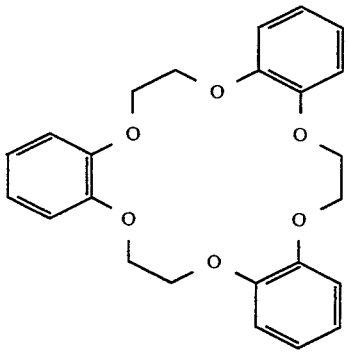
S-27
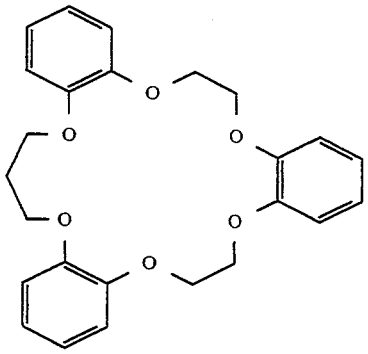
S-28
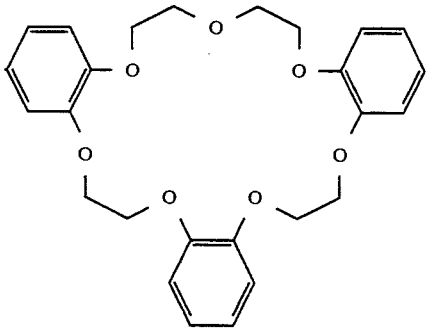
S-29
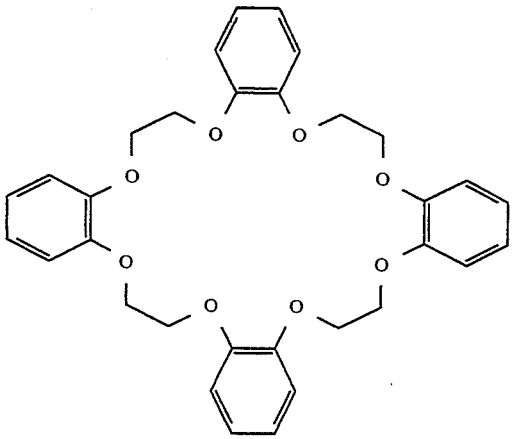
S-30
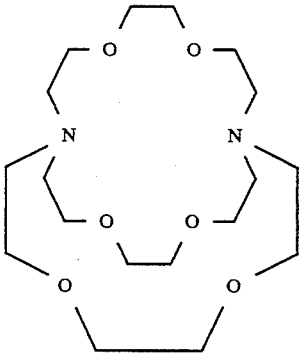
S-31
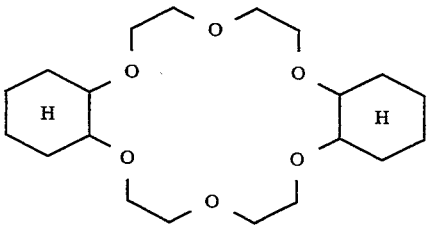
S-32

-continued
S-33
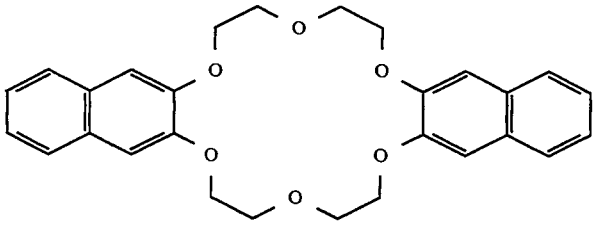
S-34
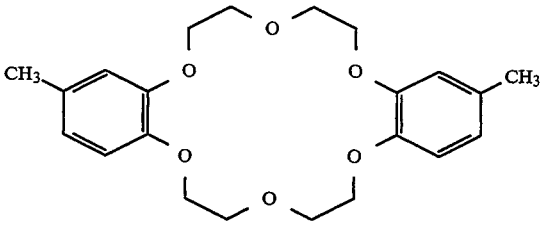
S-35
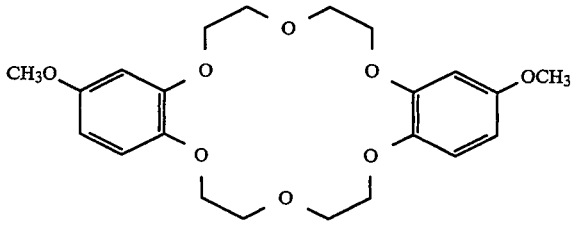
S-36
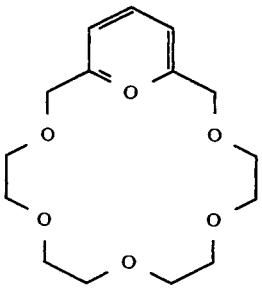
S-37
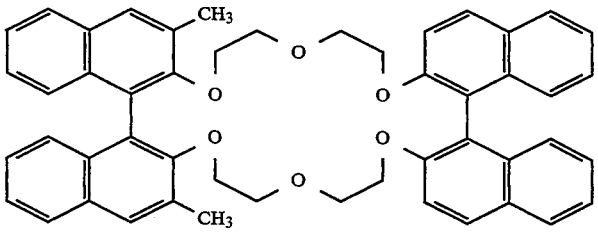
S-38
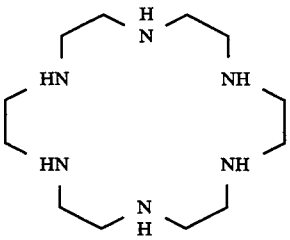
S-39
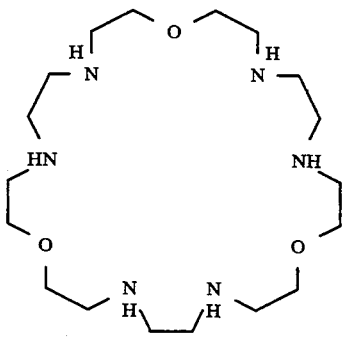
Macrocyclic compounds containing a hetero-atom of the present invention may be added to hydrophilic colloid containing silver halide grains after being dissolved into water or hydrophilic organic solvents such as methanol, ethanol, fluorinated alcohol. With regard to addition timing, any time is allowed provided that it is before coating emulsions. However, it is preferred to be added before completion of chemical sensitization.

The amount of adding macrocyclic compounds of the present invention is different depending upon the kind of them. However, it is ordinarily in the range of $1\times10^{-6}$ to $1\times10^{-1}$ mol and preferably $5\times10^{-6}$ to $1\times10^{-2}$ mol per mol of silver halide.

The super sensitizers of the present invention are so effective in terms of the effects of the present invention to red sensitive sensitizing dyes as to be desirable. They are especially useful to cyanine dyes represented by formulas (2) and (3), of the red sensitive sensitizing dyes.

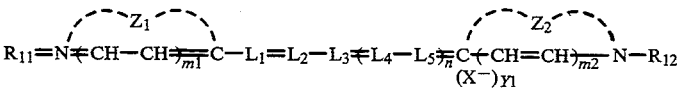

Formula (2)

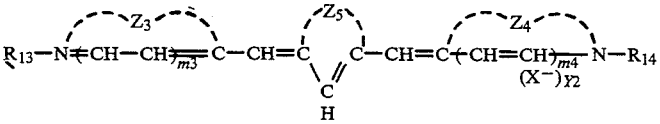

Formula (3)

wherein $R_{11}$, $R_{12}$, $R_{13}$ and $R_{14}$ independently represent an alkyl group, an alkenyl group or an aryl group; $L_1$, $L_2$, $L_3$, $L_4$ and $L_5$ independently represent a methine group; $Z_1$, $Z_2$, $Z_3$ and $Z_4$ independently represent an atomic group necessary for forming a 5- or 6-membered heterocyclic ring; $Z_5$ represents an atomic group necessary for forming a 6-member ring; $m_1$, $m_2$, $m_3$ and $m_4$ independently represent 0 or 1; n represents 0 or 1; $X^-$ represents an acid anion; $Y_1$ and $Y_2$ independently represent 0 or 1, provided that $Y_1$ and $Y_2$ independently represent 0 when the compound forms an inner salt.

In sensitizing dyes used in the present invention, alkyl groups represented by $R_1$, $R_2$, $R_3$ and $R_4$ in formulas (2) or (3) may be branched. In addition, sensitizing dyes having 10 or less carbons are more preferable. They may have a substituent. As a substituent, a sulfo group, an aryl group, a carboxy group, an amine (primary, secondary and tertiary) group, an alkoxy group, an aryloxy group, a hydroxy group, an alkoxycarbonyl group, an acyloxy group, an acyl group, an aminocarbonyl group or a cyan group or a halogen atom can be cited. Practical examples of alkyl groups are a methyl group, an ethyl group, a propyl group, a butyl group, a pentyl group, a hexyl group, a heptyl group, a sulfoethyl group, a sulfopropyl group, a sulfobutyl group, a benzyl group, a phenethyl group, a carboxyethyl group, a carboxymethyl group, a dimethylaminopropyl group, a methoxyethyl group, a phenoxypropyl group, a methylsulfonylethyl group, a p-t-butylphenoxyethyl group, a cyclohexyl group, an octyl group, a decyl group, a carbamoylethyl group, a sulfophenethyl group, a sulfobenzyl group, a 2-hydroxy-3-sulfopropyl group, an ethoxycarbonylethyl group, a 2,3-disulfopropoxypropyl group, a sulfopropoxyethoxyethyl group, a trifluoroethyl group, a carboxybenzyl group, a cyanopropyl group, a p-carboxyphenethyl group, an ethoxycarbanylmethyl group, a pivaloylpropyl group, a propyonylethyl group, an anisyl group, an acetoxyethyl group, a benzoyloxypropyl group, a chloroethyl group, a morphorinoethyl group, an acetylaminoethyl group, an N-ethylaminocarbonylpropyl group and a cyanoethyl group are cited.

As alkenyl groups, those having 10 or less carbons are preferable. For example, an allyl group, a 2-butenyl group and a 2-propenyl group are cited.

In addition, as aryl groups, a phenyl group, a carboxyphenyl group and a sulfonyl group are cited.

A methine group represented by $L_1$, $L_2$, $L_3$, $L_4$ and $L_6$ in formula (2) or (3) may have a substituent. When it has a substituent, it is represented by a formula (—$CR_5$—). As a group represented by $R_5$, straight-chained or branched chained alkyl groups (for example, a methyl group, an ethyl group, a propyl group, a butyl group, a carboxyl group and a benzyl group), alkoxy groups (for example, a methoxy group and an ethoxy group) and aryl groups (for example, a phenyl group and a tolyl group) are cited.

As anions represented by $X^-$ in formulas (2) and (3), a chloride ion, bromide ion, iodide ion, perchloroxide ion, fluorinated borate ion, p-toluenesulfonic acid ion, ethylsulfonic acid ion, methylsulfonic acid ion and nitrate ion are cited.

In addition, of the sensitizing dyes represented by the above-mentioned formula (2) or (3), especially useful sensitizing dyes can be represented by the following formulas (4) and (5).

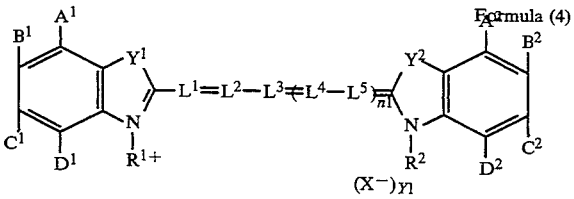

Formula (4)

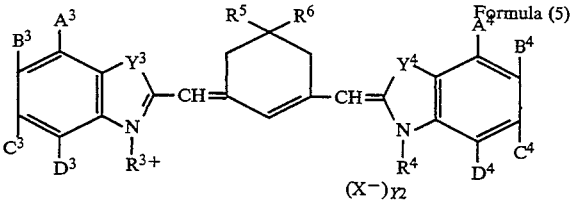

Formula (5)

wherein $Y^1$, $Y^2$, $Y^3$ and $Y^4$ independently represent an oxygen atom, a sulfur atom or a selenium atom; $A^1$, $A^2$, $A^3$, $A^4$, $B^1$, $B^2$, $B^3$, $B^4$, $C^1$, $C^2$, $C^3$, $C^4$, $D^1$, $D^2$, $D^3$ and $D^4$ independently represent a hydrogen atom, a halogen atom, an alkyl group, an alkoxy group, a phenyl group, a cyano group, a nitro group or an alkoxycarbonyl group, provided that at least one combination of $A^1$ and $B^1$, $B^1$ and $C^1$, $C^1$ and $D^1$, $A^2$ and $B^2$, $B^2$ and $C^2$, $C^2$ and $D^2$, $A^3$ and $B^2$, $B^3$ and $C^3$, $C^3$ and $D^3$, $A^4$ and $B^4$, $B^4$ and $C^4$ and $C^4$ and $D^4$ may be bound together to form a benzene ring; $R^5$ and $R^6$ independently represent a lower alkyl group; $R^1$, $R^2$, $R^3$, $R^4$, $L^1$, $L^2$, $L^3$, $L^4$, $L^5$, $X^-$, $n^1$, $Y_1$ and $Y^2$ are the same as $R_1$, $R_2$, $R_3$, $R_4$, $L_1$, $L_2$, $L_3$, $L_4$, $L_5$, $X^-$, $n^1$ $Y_1$ and $Y_2$ in the above-mentioned formula (2) or (3).

As alkyl groups represented by $A^1$, $A^2$, $A^3$, $A^4$, $B^1$, $B^2$, $B^3$, $B^4$, $C^1$, $C^2$, $C^3$, $C^4$, $D^1$, $D^2$, $D^3$ and $D^4$ in formula (4) or (5), straight-chained or branch-chained lower alkyl groups having 1 to 5 carbons (for example, a methyl group, an ethyl group, a propyl group, a butyl group and a trifluoromethyl group) are cited. As alkoxy groups represented by them, straight-chained or branched-chained alkoxy groups having 1 to 5 carbons (for example, a methoxy group and an ethoxy group) are cited. As halogen atoms represented by them, fluorine, chlorine, bromine or iodine are cited. As phenyl groups, a phenyl group not having a substituent, a hydroxyphenyl group and a carboxyphenyl group are cited. As alkoxycarbonyl groups, a methoxycarbonyl group and an ethoxycarbonyl group are cited. In addition, $n^1$ represents 0 or 1, provided that 1 is preferable.

Next, practical examples of red sensitive sensitizing dyes of the present invention are illustrated. However, the present invention is not limited thereto.

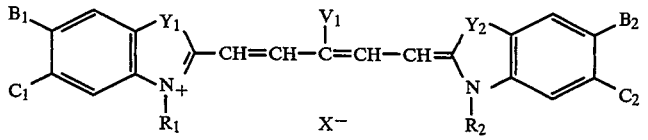

| Illustrated compound No. | $Y_1$ | $Y_2$ | $B_1$ | $C_1$ | $B_2$ | $C_2$ | $R_1$ | $R_2$ | $V_1$ | $X^-$ |
|---|---|---|---|---|---|---|---|---|---|---|
| I-1 | Se | Se | H | H | H | H | $C_2H_5$ | $C_2H_5$ | H | I |
| I-2 | S | S | H | H | H | H | $C_2H_5$ | $C_2H_5$ | H | I |
| I-3 | Se | Se | H | H | H | H | $(CH_2)_2OCH_3$ | $(CH_2)_2OCH_3$ | H | Br |
| I-4 | Se | S | H | H | H | H | $(CH_2)_3SO_3H$ | $C_2H_5$ | H | — |
| I-5 | S | S | H | $OCH_3$ | H | H | $C_2H_5$ | $C_2H_4OH$ | $C_2H_5$ | Br |
| I-6 | S | S | $C_2H_5$ | H | $C_2H_5$ | H | $C_5H_{11}$ | $C_5H_{11}$ | $C_2H_5$ | Br |
| I-7 | S | S | $C_2H_5$ | H | $C_2H_5$ | H | $C_5H_{11}$ | $C_5H_{11}$ | $C_4H_9$ | Br |
| I-8 | S | S | $OCH_3$ | $OCH_3$ | $OCH_3$ | $OCH_3$ | $C_2H_5$ | $C_2H_5$ | $CH_3$ | I |

1-9

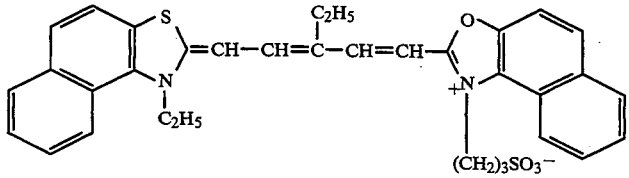

1-10

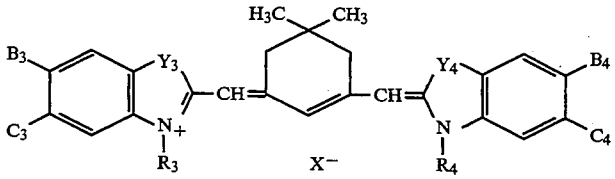

| Illustrated compound No. | $Y_3$ | $Y_4$ | $B_3$ | $C_3$ | $B_4$ | $C_4$ | $R_3$ | $R_4$ | $X^-$ |
|---|---|---|---|---|---|---|---|---|---|
| II-1 | S | S | H | H | H | H | $C_2H_5$ | $C_2H_5$ | Br |
| II-2 | S | S | $CH_3$ | H | H | H | $C_2H_5$ | $C_2H_5$ | Br |
| II-3 | S | S | $CH_3$ | H | $CH_3$ | H | $C_2H_5$ | $C_2H_5$ | Br |
| II-4 | S | S | H | H | H | H | $C_2H_5$ | $C_3H_7$ | Br |
| II-5 | S | S | H | H | H | H | $C_2H_5$ | $C_4H_9$ | Br |
| II-6 | S | S | H | H | H | H | $C_2H_5$ | $C_5H_{11}$ | Br |
| II-7 | S | S | H | H | H | H | $C_2H_5$ | $C_7H_{15}$ | Br |
| II-8 | S | S | H | H | H | H | $C_2H_5$ | $C_{10}H_{21}$ | Br |
| II-9 | S | S | H | H | H | H | $C_3H_7$ | $C_3H_7$ | Br |
| II-10 | S | S | H | H | H | H | $C_4H_9$ | $C_4H_9$ | $PTS^-$* |
| II-11 | S | S | H | H | H | H | $C_5H_{11}$ | $C_5H_{11}$ | Br |
| II-12 | S | S | H | H | H | H | $C_7H_{15}$ | $C_7H_{15}$ | Br |
| II-13 | S | S | $CH_3$ | H | H | H | $C_2H_5$ | $C_5H_{11}$ | Br |
| II-14 | S | S | $CH_3$ | H | $CH_3$ | H | $C_2H_5$ | $C_5H_{11}$ | Br |
| II-15 | S | S | $OCH_3$ | H | H | H | $C_2H_5$ | $C_2H_5$ | Br |
| II-16 | S | S | $OCH_3$ | H | H | H | $C_2H_5$ | $C_5H_{11}$ | Br |
| II-17 | S | S | $CH_3$ | $CH_3$ | $CH_3$ | $CH_3$ | $C_2H_5$ | $C_2H_5$ | Br |
| II-18 | S | S | $C_3H_{7(i)}$ | H | $C_3H_{7(i)}$ | H | $C_2H_5$ | $C_2H_5$ | Br |
| II-19 | S | S | H | H | H | H | $C_2H_5$ | $(CH_2)_3SO_3^-$ | — |
| II-20 | S | S | $CH_3$ | H | $CH_3$ | H | $C_2H_5$ | $(CH_2)_4SO_3^-$ | — |
| II-21 | S | S | $CH_3$ | H | $CH_3$ | H | $(CH_2)_3SO_3HN(C_2H_5)_3$ | $(CH_2)_3SO_3^-$ | — |
| II-22 | S | O | H | H | H | H | $C_2H_5$ | $C_2H_5$ | Br |
| II-23 | S | O | $CH_3$ | H | $CH_3$ | H | $C_2H_5$ | $C_5H_{11}$ | Br |
| II-24 | Se | Se | H | H | H | H | $C_2H_5$ | $C_2H_5$ | Br |
| II-25 | Se | Se | $CH_3$ | H | $CH_3$ | H | $C_2H_5$ | $C_2H_5$ | Br |

-continued

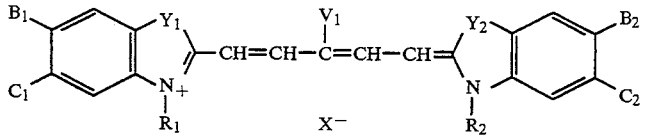

II-26

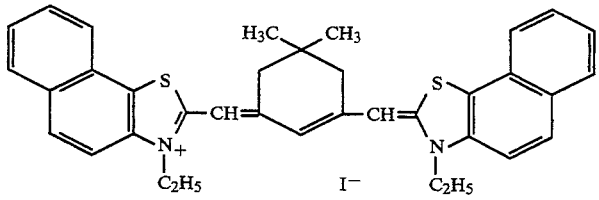

II-27

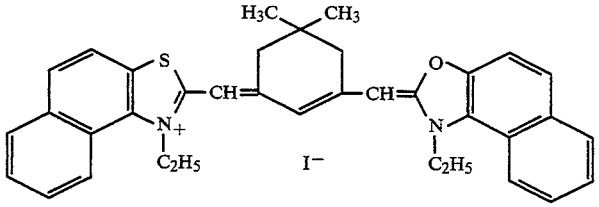

(*PTS: Paratoluene sulfonic acid)

The above-mentioned red sensitive sensitizing dyes caneasily be synthesized by a method described in The Chemistry of Heterocyclic Compounds written by F. M. Harmer, Volume 18 and The Cyanine Dyes and Related Compounds, New York, 1964 published by A. Weissberger ed. Interscience Co., Ltd.).

There is no limitation to the amount of adding the above-mentioned red sensitive sensitizing dyes. However, it is preferred to add $2\times10^{-8}$ to $1\times10^{-2}$ mol per mol of silver halide.

Any blue sensitive sensitizing dyes and green sensitive sensitizing dyes can be used for the present invention. As blue sensitive sensitizing dyes, BS-1 through 8 described on pp. 108 and 109 of Japanese Patnet O.P.I. Publication No. 251840/1991 are preferable. As green sensitive sensitizing dyes, GS-1 through 5 described on page 110 of aforesaid patent application are preferable.

As an apparatus and a method for preparing silver halide emulsions, various conventional ones known in the field can be used.

The silver halide emulsions of the present invention may be prepared through any of those including an acid process, a neutral process and an ammonia process. Aforesaid grains may be grown directly, or may be grown after producing seed grains. A method for producing seed grains and a method for growing them may be the same or different.

In addition, as a method to cause soluble silver salt and a soluble halogenated salt to react, any of a normal precipitation method, a reverse precipitation method, a double-jet method and combination thereof are allowed. Of them, those obtained through a double-jet method is desirable. In addition, as one type of a double-jet method, pAg-controlled double jet method described in Japanese Patent OPI Publication No. 48521/1979 can also be used.

In addition, an apparatus disclosed in Japanese Patent O.P.I. Publication Nos. 92523/1982 and 92524/1982 wherein water-soluble silver salt and water-soluble halogenated compound salt aqueous solution is fed from an addition device placed in an initial solution for reaction, an apparatus disclosed in German Patent No. 2921164 wherein the concentration of water-soluble silver salt and water-soluble halogenated compound salt aqueous solution is continuously changed for adding, or an apparatus disclosed in Japanese Patent Publication No. 501776/1981 wherein grains are formed while the distance between each silver halide grain is kept constant by taking an initial solution outside of a reactor and concentrating it by the use of a ultra filtration method may be used.

In addition, if necessary, silver halide solvents such as thioether may be used. In addition, compounds having a mercapto group and compounds such as nitrogen-containing heterocycles or sensitizing dyes may be used by adding during formation of silver halide grains or after completion of forming grains.

The silver halide emulsions of the present invention may be sensitized by the use of sensitizing methods using gold compounds and sensitizing methods using chalcogen sensitizers in combination.

As chalcogen sensitizers applicable to the silver halide emulsions of the present invention, sulfur sensitizers, selenium sensitizers and tellurium sensitizers can be used. Among them, sulfur sensitizers are desirable. As sulfur sensitizers, thiosulfate, allylthiocarbamidothiourea, allylisothiacyanate, cystine, p-toluenethiosulfonate salt and rhodanine are cited.

The gold sensitizers applicable to the silver halide emulsions of the present invention can be added in the form of gold chloride, silver chloride, gold sulfide, gold thiosulfate and various gold complex. As compounds to be used therein, dimethylrhodanine, thiocyanate, mercaptotetrazole and mercaptotriazole are cited.

The added amount of gold compounds is different depending upon the kind of silver halide emulsion, kind of compounds used and ripening conditions. Ordinarily, it is $1\times10^{-8}$ mol per mol of silver halide.

For the silver halide emulsions of the present invention, conventional anti-foggants and stabilizers can be used for preventing fog which occurs during preparation step of a silver halide photographic light-sensitive material, for reducing fluctuation in properties during storage and preventing fog which occurs when being developed. As an example of compounds used for such purposes, compounds represented by formula (II) described in the lower column on page 7 of Japanese Patent O.P.I. Publication No. 146036/1990 are cited. Practical examples thereof are compounds (IIa-1) through (IIa-8) and (II-b) through (IIb-7) and 1-(3-methoxyphenyl)-5-mercaptotetrazole are cited. These compounds are added, depending upon their purposes, in a preparation step, in a chemical sensitization step, at the end of chemical sensitization step and in a preparation step for a coating solution.

From the emulsions containing the silver halide grains, unnecessary salts may be removed when the growth of silver halide grains are completed or they may be incorporated as they are. Aforesaid salts can be removed by the use of a method described in Research Disclosure No. 17643.

Arbitrary form of silver halide grains of the present invention can be used. One preferred example is a cubic having {100} as a crystal surface. In addition, by the use of technologies disclosed in U.S. Pat. Nos. 4,183,756 and 4,225,666, Japanese Patent O.P.I. Publication No. 26589/1980, Japanese Patent Publication No. 42737/1980 and The Journal of Photographic Science (J. Photogr. Sci.) 21 and 39 (1973), octahedral, tetradecahedral and dodecahedral grains may be prepared and used. In addition, grains having twinned surface may be used.

The silver halide grains of the present invention may employ grains composed of a single form and may also employ grains wherein various forms of grains are mixed.

There is no limitation to the grain size of silver halide grains. However, considering properties for rapid processing, sensitivity and other phoographic properties, the preferred size is 0.2 to 1.6 μm and the more preferred size is 0.25 to 1.2 μm. Incidentally, the above-mentioned grains can be measured by the use of various methods commonly used in this field. The typical ones are described in "Analysis Method for Grain Size" Loveland (A.S.T.M. Symposium on Light Microscopy, 1955, pp 94 to 122) or the second chapter of "The Theory of Photographic Process" (written by Meeth and James, 3rd edition, published by MacMillan Inc. (1966)).

Grain size can be calculated by the use of a projected area of grain or the approximation of a diameter.

When the size of grain is substantially uniform, the grain distribution can be represented by the use of a diameter or a projected area fairly accurately. The grain distribution of silver halide grains may be poly-dispersed or mono-dispersed. The preferable is a mono-dispersed silver halide having a fluctuation coefficient of the grain distribution of silver halide grains of not more than 0.22 and more preferably not more than 0.15. Here, "fluctuation coefficient" is a coefficient showing the width of grain distribution, which is defined as follows:

Fluctuation coefficient=S/R (wherein S represent a standard deviation of grain distribution; R represents an average grain size.)

"grain size" referred here is defined to be, in the case of a spherical silver halide grains", a diameter thereof and, in the case of grains other than cubic or spherical one, a diameter thereof when the projected image is converted to the circle having the same area.

To the silver halide photographic light-sensitive materials of the present invention, dyes having absorption ability for various wavelength can be used for preventing irradiation and halation.

For couplers used in the silver halide photographic light-sensitive materials of the present invention, there can be used any compounds which can form a coupling substance having a spectral absorption maximum wavelength in a wavelength region longer than 340 nm through a coupling reaction with an oxidized product of a color developing agent. The typical ones are yellow couplers having spectral absorption maximum wavelength in the wavelength region of 350 to 500 nm, magenta couplers having spectral absorption maximum wavelength in the wavelength region of 500 to 600 nm and cyan couplers having spectral absorption maximum wavelength in the wavelength region of 600 to 750 nm.

As yellow couplers which can be preferably used for the silver halide photographic light-sensitive materials of the present invention, couplers represented by formula (Y-I) described on page 8 of Japanese Patent O.P.I. Publication No. 114154/1992 are cited. Practicaly, YC-1 through YC-9 described on pages 9 through 11 of aforesaid application can be cited. Of them, YC-8 and YC-9 which are described on page 11 of aforesaid application can reproduce preferred yellow color tone.

As magenta couplers which can be preferably used for the silver halide photographic light-sensitive materials of the present invention, couplers represented by formula (M-I) and (M-II) described on page 12 of Japanese Patent O.P.I. Publication No. 114154/1992 are cited. Practicaly, MC-1 through MC-11 described on pages 13 through 16 of aforesaid application can be cited. Of them, MC-8 and MC-11 which are described on pages 15 to 16 of aforesaid application are so preferred as to be excellent in color reproduction for a range from blue through violet and red and also excellent in description ability for details.

As cyan couplers preferably applicable to the silver halide photographic light-sensitive materials of the present invention, couplers represented by formula (C-I) and (C-II) described on page 17 of Japanese Patent O.P.I. Publication No. 114154/1992 are cited. Practically, compounds CC-1 through CC-9 described from page 18 to page 21 of aforesaid Application are cited.

When an oil-in-water emulsification dispersion method is used for adding couplers used for the silver halide photographic light-sensitive materials of the present invention, it is ordinary to dissolve the coupler with water-insoluble and high boiling organic solvents having a boiling point of 150° C. and, if necessary, with low boiling and/or water-soluble organic solvents in combination, and then, to emulsify and disperse into a hydrophilic binder such as a gelatin aqueous solution using surfactants. As dispersing means, an stirrer, a homogenizer, a colloid mill, a flow jet mixer and a supersonic disperser can be used. After completing the dispersion, or during the course of dispersion, a step for removing low-boiling organic solvents may be added. As high-boiling organic solvents which can be used for dissolving couplers for dispersion, phthalic acid ester such as dioctylphthalate and phosphoric acid ester such as tricresylphosphate are preferably used.

In addition, in place of a method to use high-boiling organic solvents, methods to dissolve low-boiling and- /or water-soluble organic solvents if necessary and to emulsify and disperse aforesaid solution into, using surfactants, a hydrophilic binder such as a gelatin aqueous solution by means of various dispersing means. In such cases, as a polymer insoluble in water and soluble in organic solvents, poly(N-t-butylacrylamido) can be cited.

In order to shift the absorption wavelength of coloring dyes, a compound (d-11) described on page 33 of Japanese Patent O.P.I. Publication No. 114154/1992 and a compound (A'-1) described on page 35 of aforesaid specification. In addition, compounds described in U.S. Pat. No. 4,774,187 which release a fluorescent dye can be used.

For the silver halide photographic light-sensitive materials of the present invention, it is advantageous to use gelatin as a binder. In addition, other gelatins, gelatin derivatives, graft polymers between gelatin and other polymers, proteins other than gelatin, sugar derivatives, cellulose derivatives and hydrophilic colloid such as synthetic hydrophilic polymers including monopolymers or copolymers can also be used if necessary.

In the present invention, hardeners for a binder may be used. As hardeners, vinylsulfone type hardeners and chlorotriazine type hardeners are preferably used. As vinylsulfone type hardeners, compounds described on the 13th line, at the upper right column on page 25 to the 2nd line, at the upper right column on page 26 in Japanese Patent O.P.I. Publication No. 249054/1986 can preferably be used. In addition, compound H-12 described on page 26 of aforesaid specification. As chlorotriazine type hardeners, compounds described from the 1st line, at the lower left column on page 3 to the 4th line from the bottom, at the lower right column on page 3 in Japanese Patent O.P.I. Publication No. 245153/1986 are preferably used. A compound represented by XII-1 described on page 4 of the latter is more preferable.

These hardners are preferably used in combination of other compounds and can be added to any layer of the material. The content of the hardner is preferably 0.1 to 10% by weight of a binder used.

In the present invention, it is preferred to use an anti-mildew agent in either of layers. As anti-mildew agents, compounds represented by a formula described on page 9 in Japanese Patent O.P.I. Publication No. 157646/1991 are preferred. As examples of practical compounds, compound Nos. 9 through 22 described from page 69 to page 70 in aforesaid specification are cited. Of them, the especially preferred compound is a compound represented by No. 9.

As reflection supports of the present invention, papers laminated with white-pigment-containing polyethylene, baryta papers, vinylchloride sheet, polypropylene containing a white pigment and a polyethylenephthalate support can be used.

Of them, supports laminated with polyorefin resin layer containing white pigments are preferable.

As white pigments to be used for the reflection supports of the present invention, inorganic and/or organic white pigments can be used. The preferred are inorganic white pigments. For example, sulfate of alkaline earth metals such as barium sulfate, carbonate salts of alkaline earth metals such as calcium carbonate, silicas such as fine silicate and synthetic silicate, calcium silicate, alumina, alumina hydrate, titanium oxide, zinc oxide, talc and clay are cited. The preferred white pigments are barium sulfate and titanium oxide.

The amount of white pigment contained in the water-proof resin layer on the surface of the reflection support of the present invention is preferable to be not less than 10% by weight, more preferable to be not less than 13% by weight and especially preferable to be not less than 15% by weight in terms of the content amount in the water-proof resin layer. The degree of dispersion of white pigment in the water-proof resin layer on a paper support of the present invention can be measured by means of a method described in Japanese Patent O.P.I. Publication No. 28640/1990. When measured by means of this method, the degree of dispersion of white pigment is preferable to be not more than 0.20, more preferable to be not more than 0.15 and especially more preferable to be not more than 0.10 in terms of fluctuation coefficient described in the aforesaid specification.

After the surface of the support is provided with corona discharge, UV ray irradiation and firing treatment if necessary, a light-sensitive materials may be coated directly or through subbing layers (one or two or more subbing layer in order to improve adhesivity, anti-static property stability in sizing, anti-abrasion property, stiffness, anti-halation property, abrasion property and/or other properties of the surface of the support. )

When a light-sensitive materials using silver halide emulsions is coated, a thickener may be used. As coating methods, an extrusion coating method and a curtain coating method is especially advantageous because they can coat 2 or more layers concurrently.

Color developing agents which are used in color developers in the present invention include aminophenol type and p-phenylenediamine type derivatives which are commonly used in various color photographic processes.

To color developers applicable to the processing of light-sensitive materials of the invention, conventional developer component compounds in addition to the above-mentioned primary aromatic amine type color developing agents can be added.

pH value of the color developers are ordinarily 9 or more and preferably about 10 to 13.

The temperature of color developer is ordinarily 15° C. or more, and normally 20° C. to 50° C.

The temperature of rapid processing is preferably 30° C. or more.

Time for developing is ordinarily from 10 seconds to 4 minutes. For rapid processing, it is preferable to be in the range from 10 seconds to 1 minute. When furthermore rapid processing is required, it is preferable to be in the range from 10 seconds to 30 seconds. However, the effects of the present invention can be offered more effectively in such a rapid processing.

In addition, when the light-sensitive material of the present invention is subjected to running processing wherein a replenisher for the color developing agent is consecutively replenished, the replenished amount of the color developer is preferably 20–150 ml, more preferably 20–120 ml and especially more preferably 20–100 ml per 1 $m^2$. However, the effects of the present invention can be offered more effectively in such a running processing with low replenishing. To the light-sensitive materials of the present invention, bleach-fixing processing is provided after subjecting to color developing.

After subjecting to bleach-fixing processing, the light-sensitive material is subjected to a washing process or a stabilizing process or a combination process thereof.

EXAMPLES

Hereunder, practical examples of the present invention are shown. However, the present invention is not limited thereto.

Example 1

To 1,000 ml of 2% aqueous gelatin solution kept at 40° C., there were added simultaneously Aqueous solution A containing 2.91 g of sodium chloride and 29.8 mg of potassium bromide and Aqueous solution B containing 8.5 g of silver nitrate spending 30 minutes while pAg was controlled to 6.5 and pH was controlled to 3.0. In addition, Aqueous solution C containing 55.3 g of sodium chloride and 565 mg of potassium bromide and Aqueous solution D containing 161 g of silver nitrate were concurrently added spending 120 minutes while pAg was controlled to 7.3 and pH was controlled to 5.5.

Here, pAg was controlled by means of a method described in Japanese Patent O.P.I. Publication No. 45437/1984. In addition, pH was controlled by the use of an aqueous solution of sulfuric acid or sodium hydroxide.

After adding was completed, the solution was subjected to desalting by the use of a 10% aqueous solution of Demol N produced by Kao Atlas Co., Ltd. and a 30% aqueous solution of magnesium sulfate. Then, the resulting solution was mixed with an aqueous gelatin solution to prepare a mono-dispersed cubic emulsion having an average grain size of 0.40 μm, fluctuation coefficient (standard deviation of the grain size/the average grain size) of 0.07 and silver chloride content 99.9 mol %. The above-mentioned emulsion was subjected to the most suitable sensitization employing sodium thiosulfate, chloroaurate, the below-mentioned compound (STAB-1) and a sensitization dye (II-3) at 65° C. so that a red sensitive silver halide emulsion EM-R1 was prepared.

EM-R2 through EM-R5 were prepared in the same manner as in EM-R1, except that comparative compound 1, comparative compound 2, S-5 and S-19 were respectively added as a super sensitizer when sensitizing.

To 1,000 ml of 2% aqueous gelatin solution kept at 40° C., there were added simultaneously Aqueous solution A containing 2.91 g of sodium chloride and 29.8 mg of potassium bromide and Aqueous solution B containing 8.5 g of silver nitrate spending 30 minutes while pAg as controlled to 6.5 and pH was controlled to 3.0. In addition, Aqueous solution C containing 55.3 g of sodium chloride, 565 mg of potassium bromide and 8.44 mg of potassium hexacyano ferric trihydrate and Aqueous solution D containing 161 g of silver nitrate were concurrently added spending 120 minutes while pAg as controlled to 7.3 and pH was controlled to 5.5.

After the solution was subjected to desalting, washing and mixing with an aqueous gelatin solution in the same manner as in EM-R1, the resulting solution was subjected to the most appropriate sensitization using sodium thiosulfate, chloroaurate, the below-mentioned compound (STAB-1) and a sensitizing dye to prepare a red sensitive silver halide emulsion EM-R6.

EM-R7 through EM-R12 were prepared in the same manner as in EM-R6, except that comparative compound 1, comparative compound 2, S-5, S-19 and S-20 were independently added as a super sensitizer when sensitizing.

EM-R13, EM-R14 and EM-R15 were obtained in the same manner as in EM-R10, except that potassium hexacyanoruthenium, indium chloride and potassium nitrate were respectively added in place of potassium hexacyano iron acid which was added in Solution D.

STAB-1

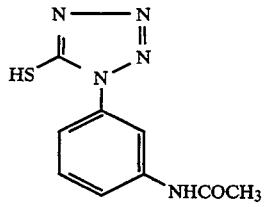

Comparative compound 1

Condensed compound between phenol and hexamethylenetetramine

Comparative compound 2

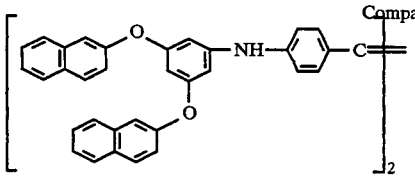

On a paper support wherein polyethylene was laminated on one side and polyethylene containing titanium oxide was laminated on the other side (a side wherein photographic structural layers were coated), there were coated the following layers to prepare Sample 101.

| Layer | Structure | Added amount ($g/m^2$) |
|---|---|---|
| Protective layer | Gelatin | 1.0 |
| Red-sensitive layer | Silver bromochloride emulsion (EM-R1) | 0.3 (in terms of silver) |
| | Cyan coupler (C-1) | 0.3 |
| | Cyan coupler (C-2) | 0.1 |
| | Dye image stabilizer (ST-1) | 0.2 |
| | Anti-stain agent (HQ-1) | 0.01 |
| | DOP | 0.2 |
| | Gelatin | 1.0 |
| Support | Polyethylene-laminated paper | 1.0 |

In addition, 2,4-dichloro-6-hydroxy-s-sodium triazine (H-1) was added as a hardener.

C-1

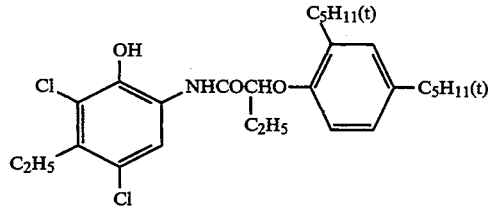

C-2

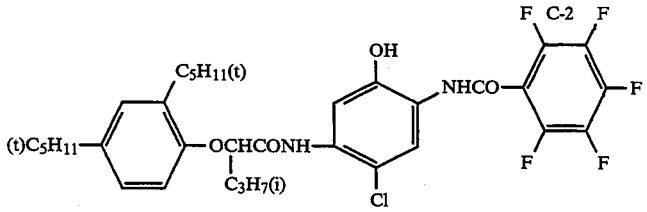

-continued

ST-1

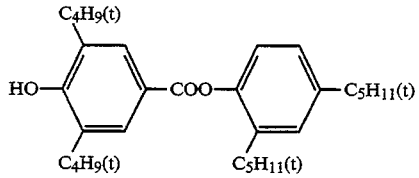

HQ-1

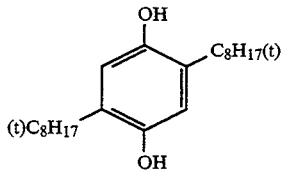

H-1

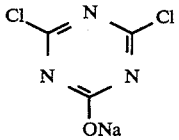

Samples 102 through 115 were prepared in the same manner as in Sample 1, except that EM-G1 was replaced by EM-G2 through EM-G15 independently.

The resulting samples were subjected to sensitometry, and the sensitivity and storage stability were evaluated in the following manner.

For the evaluation of sensitivity, each sample was subjected to optical wedge exposure to light through a red filter for 0.5 second, and was subjected to the following development. The density of the resulting samples was measured by the use of an optical densitometer (Model PDA-65 produced by Konica Corporation). The inverse of the exposure amount necessary for providing density higher than fog density by 0.8 was used to show sensitivity with a relative value to that of sample 101, the sensitivity of Sample 101 being 100. In order to evaluate storage stability, each sample was divided in two. One of them was stored for 3 weeks at 40° C. and 40% RH and the other of them was stored in a refrigerator. The samples, after the storage, were subjected to wedge exposure to light using a red filter for 0.5 second. Then, they were subjected to the following development. The exposure amount providing density of 1.0 in samples stored in the refrigerator was measured, and the value (ΔD) obtained by extracting 1.0 from the density corresponding to this exposure amount mentioned above in each sample subjected to storage for 3 weeks at 40° C. and 40% RH was used to show the fluctuation after the storage. The closer this ΔD is to 0, the fluctuation after storage is smaller.

Processing conditions used for evaluation were as follows:

| Processing step | Temperature | Time |
|---|---|---|
| Color developing | 35.0 ± 0.3° C. | 45 seconds |
| Bleach-fixing | 35.0 ± 0.5° C. | 45 seconds |
| Stabilizing | 30–34° C. | 90 seconds |
| Drying | 60–80° C. | 60 seconds |

| (Color developing solution) | |
|---|---|
| Pure water | 800 ml |
| Triethanolamine | 10 g |
| N,N-diethylhydroxylamine | 5 g |
| Potassium bromide | 0.02 g |
| Potassium chloride | 2 g |
| Potassium sulfite | 0.3 g |
| 1-hydroxyethylidene-1,1-diphosphate | 1.0 g |
| Ethylenediamine tetraacetate | 1.0 g |
| Disodium catechol-3.5-diphosphate | 1.0 g |
| N-ethyl-N-β-methanesulfonamidoethyl-3-methyl-4-aminoaniline sulfate | 4.5 g |
| Fluorescent brightening agent (4,4'-diaminostylbenesulfonate derivative) | 1.0 g |
| Potassium carbonate | 27 g |
| Water was added to make 1 l in total and pH was regulated to 10.10. | |
| (Bleach-fixer) | |
| Ethylenediamine tetraacetate ferric ammonium dehydrate | 60 g |
| Ethylenediamine tetraacetate | 3 g |
| Ammonium thiosulfate (70% aqueous solution) | 100 ml |
| Ammonium sulfite (40% aqueous solution) | 27.5 ml |
| Water was added to make 1 l in total, and pH was regulated to potassium carbonate or glacial acetic acid to 5.7. | |
| (Stabilizer) | |
| 5-chloro-2-methyl-4-isothiazoline-3-on | 1.0 g |
| Ethylene glycol | 1.0 g |
| 1-hydroxyethylidene 1,1-diphosphate | 2.0 g |
| Ethylenediamine tetraacetate | 1.0 g |
| Ammonium hydroxide (20% aqueous solution) | 3.0 g |
| Fluorescent brightening agent (4,4'-diaminostylbenesulfonate derivative) | 1.5 g |

Water was added to make 1 l in total, and pH was regulated to 7.0 with sulfuric acid or potassium hydroxide.

Table 2 shows the results of the evaluation.

TABLE 2

| Name of Sample | Contents of Sample: Name of Emulsion | Metal ion in grains | Super sensitizer | Results in terms of property: Sensitivity | Preservability after aging | Note |
|---|---|---|---|---|---|---|
| 101 | EM-R1 | None | None | 100 | −0.12 | Comparative |
| 102 | EM-R2 | None | Comparative compound-1 | 231 | −0.28 | Comparative |
| 103 | EM-R3 | None | Comparative compound-2 | 225 | −0.21 | Comparative |
| 104 | EM-R4 | None | S-5 | 221 | −0.10 | Comparative |
| 105 | EM-R5 | None | S-19 | 243 | −0.11 | Comparative |
| 106 | EM-R6 | $K_4Fe(CN)_6$ | None | 126 | −0.16 | Comparative |
| 107 | EM-R7 | $K_4Fe(CN)_6$ | Comparative compound-1 | 302 | −0.37 | Comparative |
| 108 | EM-R8 | $K_4Fe(CN)_6$ | Comparative compound-2 | 295 | −0.30 | Comparative |
| 109 | EM-R9 | $K_4Fe(CN)_6$ | S-5 | 345 | −0.11 | Invention |
| 110 | EM-R10 | $K_4Fe(CN)_6$ | S-19 | 369 | −0.12 | Invention |
| 111 | EM-R11 | $K_4Fe(CN)_6$ | S-10 | 357 | −0.11 | Invention |
| 112 | EM-R12 | $K_4Fe(CN)_6$ | S-11 | 346 | −0.11 | Invention |
| 113 | EM-R13 | $K_4Fe(CN)_6$ | S-19 | 366 | −0.12 | Invention |

TABLE 2-continued

| Name of Sample | Contents of Sample: Name of Emulsion | Metal ion in grains | Super sensitizer | Results in terms of property: Sensitivity | Preservability after aging | Note |
|---|---|---|---|---|---|---|
| 114 | EM-R14 | $InCl_3$ | S-19 | 341 | −0.11 | Invention |
| 115 | EM-R15 | $Ga(NO_3)_3$ | S-19 | 349 | −0.12 | Invention |

From the results shown in Table 2, the remarbable effects of the present invention is understood apparently.

In emulsions wherein metal ions are not doped on silver halide grains, super sensitizers of the present invention offer almost the same sensitivity as conventional super sensitizers. However, in emulsions wherein metal ions are doped on silver halide grains, super sensitizers of the present invention offer extremely high sensitivity. After long term storage, on the other hand, samples employing comparative super sensitizers wherein metal ions were not doped resulted in remarkable reduction in terms of sensitivity (see comparison between 101 and 102/103). However, emulsions wherein metal ions are doped resulted in furthermore deterioration (see comparison between 102/103 and 107/108). To the contrary, the emulsions employing the super sensitizers in the present invention resulted in less reduction in sensitivity and thereby excellent storage stability.

As explained above, due to emulsions doped with metal ions and prepareded with super sensitizers of the present invention, a high speed light-sensitive material excellent in long term stability can be obtained. Incidentally, in comparison between super sensitizers S-5 and S-19 of the present invention, it is understood that a light-sensitive material using S-19 has higher sensitivity and macrocyclic compound having 2 aromatic group rings is more preferable.

Example 2

EM-R16 through EM-R25 were prepared in the same manner as in EM-R6 through EM-R15 in Example 1, respectively except that 0.024 mg of potassium iridium hexachloride was added to Solution C.

Samples 201 through 210 were prepared in the same manner as in Sample 101 of Example 1, except that EM-R16 through EM-R25 were used in place of EM-R1. In addition, as Sample 211, Sample 106 of Example 1 was used.

Sensitivity and storage stability were evaluated in the same manner as in Example 1. In addition, in order to investigate fluctuation in sensitivity when exposure illuminance is varied, the samples were subjected to exposure to light for 10 seconds so that the exposure amount may be the same as that in the sensitometry in Example 1, and the resulting sensitivity of the samples was represented by a ralative sensitivity value, the sensitivity of 0.05 second exposure being defined to be 100. The closer to 100 the value, the more excellent the fluctuation.

TABLE 3

| Name of Sample | Contents of Samples: Emulsion | Metal ion in grains | Super sensatizer | Results in properties: Sensitivity | Storage stability | Reciprocity law failure | Remarks |
|---|---|---|---|---|---|---|---|
| 201 | EM-R16 | $K_4Fe(CN)_6$ and $K_3IrCl_6$ | None | 100 | −0.12 | 83 | Comparative |
| 202 | EM-R17 | $K_4Fe(CN)_6$ and $K_3IrCl_6$ | Comparative compound 1 | 240 | −0.45 | 84 | Comparative |
| 203 | EM-R18 | $K_4Fe(CN)_6$ and $K_3IrCl_6$ | Comparative compound 2 | 225 | −0.34 | 84 | Comparative |
| 204 | EM-R19 | $K_4Fe(CN)_6$ and $K_3IrCl_6$ | S-5 | 287 | −0.15 | 84 | Invention |
| 205 | EM-R20 | $K_4Fe(CN)_6$ and $K_3IrCl_6$ | S-19 | 302 | −0.16 | 87 | Invention |
| 206 | EM-R21 | $K_4Fe(CN)_6$ and $K_3IrCl_6$ | S-10 | 294 | −0.15 | 86 | Invention |
| 207 | EM-R22 | $K_4Fe(CN)_6$ and $K_3IrCl_6$ | S-11 | 285 | −0.16 | 85 | Invention |
| 208 | EM-R23 | $KRu(CN)_6$ and $K_3IrCl_6$ | S-19 | 301 | −0.16 | 87 | Invention |
| 209 | EM-R24 | $InCl_3$ and $K_3IrCl_6$ | S-19 | 290 | −0.16 | 86 | Invention |
| 210 | EM-R25 | $Ga(NO_3)_3$ and $K_3IrCl_6$ | S-19 | 289 | −0.16 | 87 | Invention |
| 211 | EM-R26 | $K_4Fe(CN)_6$ | None | 82 | −0.16 | 71 | Comparative |

As is apparent from Table 3, even when two kinds of metal ions are used in combination for each emulsion, samples using super sensitizers of the present invention have high sensitivity and are excellent in storage stability. In addition, when using potassium iridium hexachloride in combination, fluctuation in sensitivity due to variation in exposure illuminance becomes smaller. This is a preferred embodiment of the present invention.

Example 3

On both sides of paper pulp having a weight of 180 g/m$^2$, there was laminated high density polyethylene to prepare a paper support. However, on a side on which emulsion layers are coated, a fused polyethylene provided with surface treatment containing dispersed anatase type titanium oxide in an amount of 15 weight % was laminated to prepare a reflection support. On this reflection support, each layer having the following composition was coated to prepare a multi-layer silver halide photographic light-sensitive material Sample 301. The coating solution was prepared as follow.

To 26.7 g of yellow coupler (Y-1), 0.67 g of additive (HQ-1) and 6.67 g of high boiling organic solvent (DNP), 60 ml of ethyl acetate was added and dissolved. The solution was emulsified and dispersed into 220 ml of a 10% aqueous gelatin solution containing 9.5 ml of 15% surfactant (SU-1) by the use of a supersonic homogenizer to prepare yellow coupler dispersant. This dispersant was mixed with blue sensitive silver halide emulsion (EM-B) to prepare a coating solution for the first layer. The 2nd layer through the 7th layer were prepared in the same manner as in the above-mentioned coating solution for the 1st layer. In addition, as a hardener, (H-2) was added to the 2nd layer and the 4th layer, and (H-2) was added to the 7th layer. As a coating aid, surfactants SU-2 and SU-3 were added.

The layer structure is as follows:

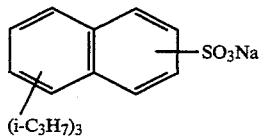

SU-1

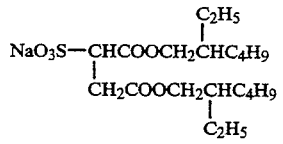

SU-2

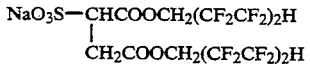

SU-3

H-2

-continued

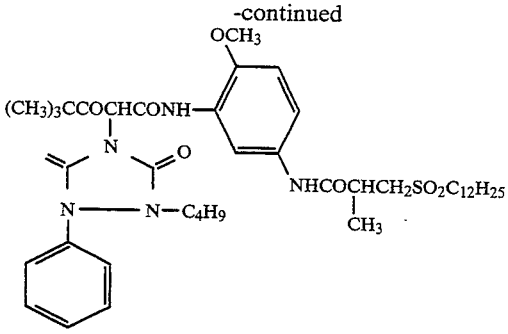

Y-1

TABLE 4

| Layer | Structure | Added amount (g/m$^2$) |
|---|---|---|
| 7th layer (Protective layer) | Gelatin | 1.00 |
| | Anti-stain agent (HQ-2) | 0.002 |
| | Anti-stain agent (HQ-3) | 0.002 |
| | Anti-stain agent (HQ-4) | 0.004 |
| | Anti-stain agent (HQ-5) | 0.02 |
| | Compounds B, C, D and E | $2 \times 10^{-5}$ independently |
| | DIDP | 0.005 |
| | Silicone dioxide | 0.003 |
| | Anti-mildew agent (F-1) | 0.002 |
| 6th layer (UV absorbing layer) | Gelatin | 0.40 |
| | AI-2 | 0.02 |
| | AI-4 | 0.01 |
| | UV absorber (UV-1) | 0.10 |
| | UV absorber (UV-2) | 0.04 |
| | UV absorber (UV-3) | 0.16 |
| | UV absorber (UV-5) | 0.04 |
| | Compound E | $4 \times 10^{-4}$ |
| | DNP | 0.20 |
| | Compound F and G | $2 \times 10^{-4}$ independently |
| | PVP | 0.03 |
| 5th layer (Red sensitive layer) | Gelatin | 1.30 |
| | Red sensitive silver bromochloride emulsion (see Table 6) | 0.21 |
| | Cyan coupler (C-1) | 0.10 |
| | Cyan coupler (C-2) | 0.28 |
| | Dye image stabilizer (ST-1) | 0.20 |
| | Anti-stain agent (HQ-1) | 0.01 |
| | HBS-1 | 0.20 |
| | DOP | 0.20 |

TABLE 5

| Layer | Structure | Added amount (g/m$^2$) |
|---|---|---|
| 4th layer (UV absorbing layer) | Gelatin | 0.94 |
| | UV absorber (UV-1) | 0.28 |
| | UV absorber (UV-2) | 0.09 |
| | UV absorber (UV-3) | 0.38 |
| | Compounds F and G | $4 \times 10^{-4}$ independently |
| | Anti-stain agent (HQ-5) | 0.10 |
| | Compound E | $1 \times 10^{-3}$ |
| | DNP | 0.40 |
| 3rd layer (Green snesitive layer) | Gelatin | 1.40 |
| | AI-1 | 0.01 |
| | Green sensitive silver bromochloride emulsion (Em-G) | 0.17 |
| | Magenta coupler (M-1) | 0.23 |
| | Dye image stabilizer (ST-3) | 0.20 |
| | Dye image stabilizer (ST-4) | 0.17 |
| | DIDP | 0.13 |
| | DBP | 0.13 |
| 2nd layer (Intermediate layer) | Gelatin | 1.20 |
| | AI-3 | 0.01 |
| | Anti-stain agent (HQ-2) | 0.03 |
| | Anti-stain agent (HQ-3) | 0.03 |
| | Anti-stain agent (HQ-4) | 0.05 |

TABLE 5-continued

| Layer | Structure | Added amount ($g/m^2$) |
|---|---|---|
| | Anti-stain agent (HQ-5) | 0.23 |
| | Compounds B, C, D and E | $3 \times 10^{-4}$ independently |
| | DIDP | 0.06 |
| | Fluorenscent brightening agent (W-1) | 0.10 |
| | Anti-mildew agent (F-1) | 0.02 |
| 1st layer (Blue sensitive layer) | Gelatin | 1.20 |
| | Blue sensitive silver bromochloride emulsion (Em-B) | 0.26 |
| | Yellow coupler (Y-1) | 0.80 |
| | Dye image stabilizer (ST-1) | 0.30 |
| | Dye image stabilizer (ST-2) | 0.20 |
| | Anti-stain agent (HQ-1) | 0.02 |
| | Compound A | $2 \times 10^{-4}$ |
| | DNP | 0.20 |
| Support | Paper laminated with polyetylene (containing minute colorant) | |

The added amount of silver halide emulsions is illustrated in terms of silver.

HQ-2

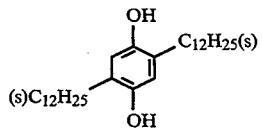

HQ-3

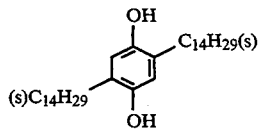

-continued

HQ-4

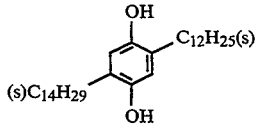

HQ-5

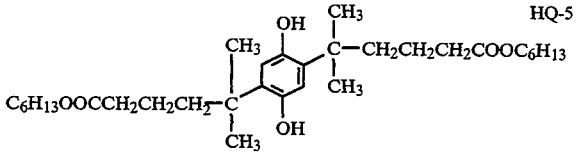

UV-1

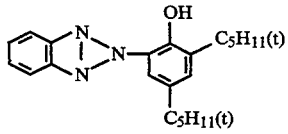

UV-2

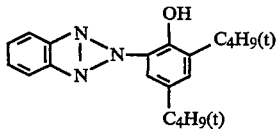

UV-3

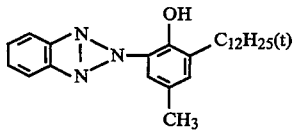

M-1

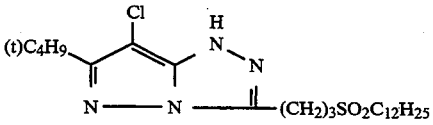

Compounds A, B, C, D and E represent quinone compounds of HQ-1, 2, 3, 4 and 5, independently.

Compound F

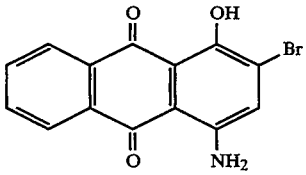

Compound G

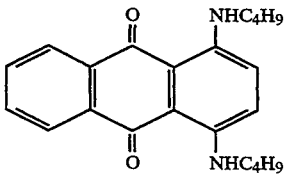

HBS-1

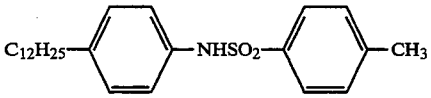

AI-1

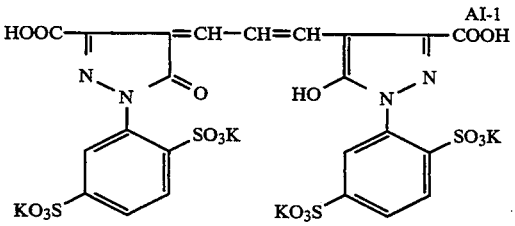

AI-2

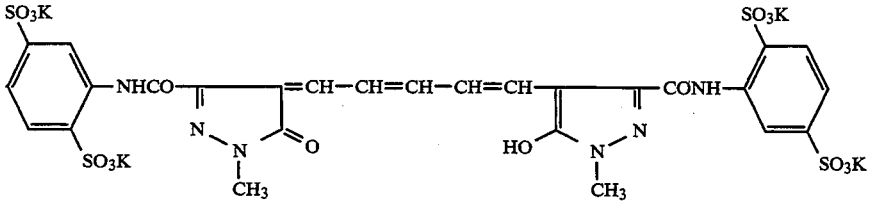

-continued

AI-3

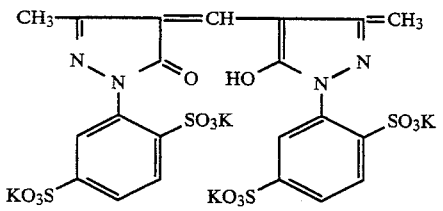

AI-4

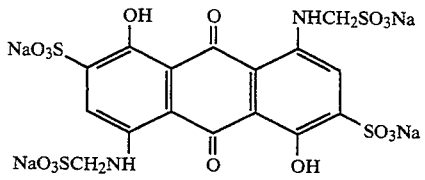

ST-2

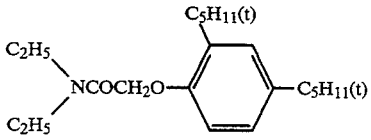

ST-3

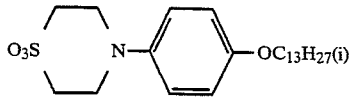

ST-4

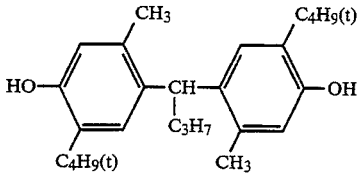

W-1

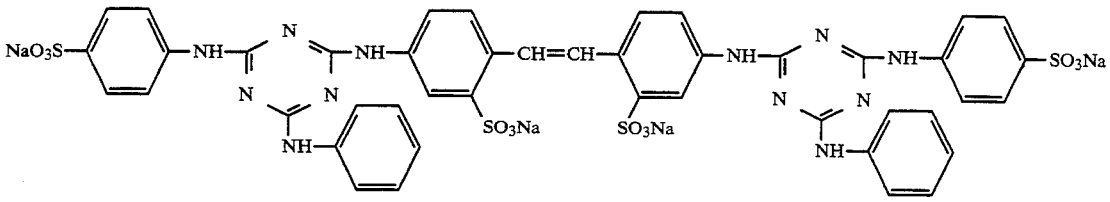

F-1

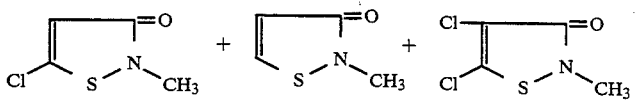

(50%) (46%) (4%) mol ratio

Preparation method of EM-B

To 1,000 ml of a 2% aqueous gelatin solution kept at 40° C., 2.90 g of sodium chloride, Aqueous solution A containing 59.5 mg of potassium bromide and Aqueous solution B containing 8.5 g of silver nitrate were concurrently added spending 30 minutes while pAg was controlled to 6.5 and pH was controlled to 3.0. In addition, Aqueous solution C containing 55.0 g of sodium chloride, 1.13 g of potassium bromide, 0.005 mg of potassium iridium (IV) hexachloride and 3 mg of potassium hexacyano ferric trihydrate and Aqueous solution D containing 161 g of silver nitrate were concurrently added while pAg was controlled to 7.3 and pH was controlled to 5.5.

After the addition was completed, the solution was subjected to desalting by the use of a 10% aqueous solution of Demol N produced by Kao Atlas Co., Ltd. and a 30% aqueous solution of magnesium sulfate. Then, the resulting solution was mixed with an aqueous gelatin solution to prepare a mono-dispersed cubic emulsion having an average grain size of 0.70 μm, fluctuation coefficient (standard deviation of the grain size/the average grain size) of 0.09 and silver chloride content of 99 mol %.

The above-mentioned emulsion was subjected to the most suitable sensitization employing sodium thiosulfate, chloroaurate, STAB-2, STAB-3 and sensitization dyes (BS-1 and BS-2) at 65° C. so that a blue sensitive silver halide emulsion EM-B was prepared.

Preparation method of EM-G

To 1,000 ml of a 2% aqueous gelatin solution kept at 40° C., 2.91 g of sodium chloride, Aqueous solution A containing 29.8 mg of potassium bromide and Aqueous solution B containing 8.5 g of silver nitrate were concurrently added spending 30 minutes while pAg was controlled to 6.5 and pH was controlled to 3.0. In addition, Aqueous solution C containing 55.3 g of sodium chloride, 565 mg of potassium bromide, 0.024 mg of potassium iridium (IV) hexachloride and 8.44 mg of potassium hexacyano ferric trihydrate and Aqueous solution D containing 161 g of silver nitrate were concurrently added spending 120 minutes while pAg was controlled to 7.3 and pH was controlled to 5.5.

After the addition was completed, the solution was subjected to desalting by the use of a 10% aqueous solution of Demol N produced by Kao Atlas Co., Ltd. and a 30% aqueous solution of magnesium sulfate. Then, the resulting solution was mixed with an aqueous gelatin to prepare a mono-dispersed cubic emulsion having an average grain size of 0.40 μm, fluctuation coefficient (standard deviation of the grain sizes/the average grain size) of 0.07 and silver chloride content of 99.9 mol %. The above-mentioned emulsion was subjected to the most suitable sensitization employing sodium thiosulfate, chloroaurate, the below-mentioned compound (STAB-1) and a sensitization dye (GS-1) at 65° C. so that a green sensitive silver halide emulsion EM-G was prepared.

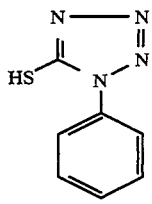

STAB-2

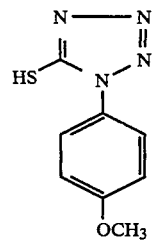

STAB-3

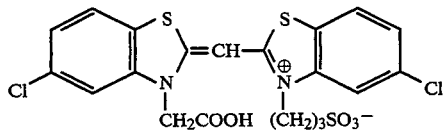

BS-1

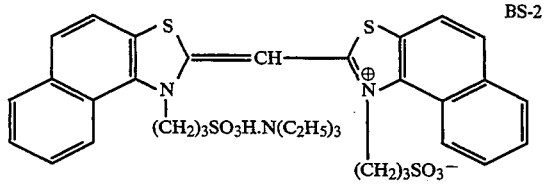

BS-2

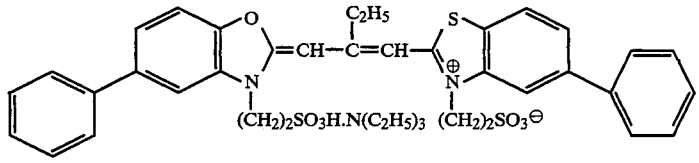

GS-1

Preparation method of EM-R16 through EM-R19

EM-R16 through EM-R19 were prepared in the same manner as in EM-R9 in Example 1, except that super sensitizer S-5 was replaced with S-17, S-21, S-22 and S-28, independently.

Light-sensitive materials using samples obtained as above mainly wherein emulsions of the red sensitive layer were replaced as shown in Table 6. They were defined to be Samples 301 through 319.

The samples obtained in the above-mentioned manner were subjected to sensitometry in the same manner as in Example 1.

The sensitivity of them were evaluated as follows; After subjecting to exposure to optical exposure for 0.5 second by the use of a red filter, they were subjected to the following development. Sensitivity was obtained in the same manner as in Example 1, and represented by relative sensitivity with that of Sample 301 as 100.

In order to evaluate storage stability, each sample was divided into two. One group was stored for 3 weeks at 40° C. and 40% RH, and the other group was stored in a refrigerator. Samples subjected to the above-mentioned storage were subjected to optical wedge exposure to light for 0.5 second through a red filter. Then, they were subjected to the following development. The exposure amount providing density of 1.0 in samples stored in the refrigerator was measured, and the value (ΔD) obtained by extracting 1.0 from the density corresponding to this exposure amount mentioned above in each sample subjected to storage for 3 weeks at 40° C. and 40% RH was used to show the fluctuation after the storage. The closer this ΔD is to 0, the fluctuation after storage is smaller.

(Processing step)

| Processing step | Processing temperature | Time | Amount of replenishing |
|---|---|---|---|
| Color developing | 38.0 ± 0.3° C. | 27 seconds | 81 ml/m$^2$ |
| Bleach-fixing | 35.0 ± 0.5° C. | 27 seconds | 54 ml/m$^2$ |
| Stabilizing | 30–34° C. | 90 seconds | 150 ml/m$^2$ |
| Drying | 60–80° C. | 30 seconds | |

The following shows a composition of a color developing solution.

(Tank solution for a color developing solution)

| | |
|---|---|
| Pure water | 800 ml |
| Diethylene glycol | 10 g |
| Potassium bromide | 0.01 g |
| Potassium chloride | 3.5 g |
| Potassium sulfite | 0.25 g |
| N-ethyl-N-(βmethanesulfonamidoethyl)-3-methyl-4-aminoaniline sulfate | 6.5 g |
| N,N-diethylhydroxylamine | 3.5 g |
| Disulfonateethylhydroxylamine | 3.5 g |
| Triethanolamine | 10.0 g |
| Diethylenetriamine pentaacetate sodium salt | 2.0 g |
| Fluorescent brightening agent (4,4'-diaminostylbenzsulfonate derivative) | 2.0 g |
| Potassium carbonate | 30 g |

Water was added to make 1 l in total and pH was regulated to 10.10.

(Replenisher for a color developing solution)

| | |
|---|---|
| Pure water | 880 ml |
| Diethyleneglycol | 10 g |
| Potassium sulfite | 0.5 g |
| N-ethyl-N-(βmethanesulfonamidoethyl)-3-methyl-4-aminoaniline sulfate | 10.5 g |
| N,N-diethylhydroxylamine | 6.0 g |
| Disulfonateethylhydroxylamine | 6.0 g |
| Triethanolamine | 10.0 g |
| Diethylenetriamine pentaacetate sodium salt | 2.0 g |
| Fluorescent brightening agent (4,4'-diaminostylbenzsulfonate derivative) | 2.5 g |
| Potassium carbonate | 30 g |

Water was added to make 1 l in total and pH was regulated to 10.60.

| | Replenishing solution for bleach-fixer | Tank solution for bleach-fixer |
|---|---|---|
| Diethylenetriamine pentaacetate ferric ammonium dehydrate | 100 g | 50 g |
| Diethylenetriamine pentaacetate | 3 g | 3 g |
| Ammonium thiosulfate (70% aqueous solution) | 200 ml | 100 ml |

-continued

| | | |
|---|---|---|
| 5-amino-1,3,4-thiadiazole-2-thiol | 2.0 g | 1.0 g |
| Ammonium sulfite (40% aqueous solution) | 50 ml | 25 ml |
| | pH 6.5 | 7.0 |

Water was added to make 1 l in total, and pH was regulated with aqueous ammonium or glacial acetic acid.

(Tank solution and a replenisher for a stabilizer

| | |
|---|---|
| Orthophenylphenol | 1.0 g |
| 5-chloro-2-methyl-4-isothiazoline-3-On | 0.02 g |
| 2-methyl-4-isothiazoline-3-on | 0.02 g |
| Diethyleneglycol | 1.0 g |
| Fluorescent brightening agent (Thinopal SFP) | 2.0 g |
| 1-hydroxyethilidene-1,1-diphosphate | 1.8 g |
| PVP (Polyvinylpyrroridone) | 1.0 g |
| Aqueous ammonia (25% aqueous solution of ammonium hydroxide) | 2.5 g |
| Ethylenediamine tetraacetate | 1.0 g |
| Ammonium sulfite (40% aqueous solution) | 10 ml |

Water was added to make 1 l in total, and pH was regulated to 7.5 with sulfuric acid or aqueous ammonia.

The stabilizing solution was replenished by means of a multi-step reverse-flow system with 3 tanks.

Color papers prepared in the above-mentioned manner were subjected to running processing using processing solutions prepared in the above-mentioned manner. After incorporating the above-mentioned color developer, the tank solution for bleach-fixing and the tank solution for stabilizing in the automatic processing machine, the above-mentioned color paper samples were subjected to running processing while replenishing the above-mentioned color developer, bleach-fixer and stabilizer.

Table 6 shows the results thereof.

TABLE 6

| Name of Sample | Contents of sample: Emulsion | Dopant | Super sensitizer | Results in terms of property: Sensitivity | Aging preservability | Note |
|---|---|---|---|---|---|---|
| 301 | EM-R1 | None | None | 100 | −0.14 | Comparative |
| 302 | EM-R2 | None | Comparative compound 1 | 234 | −0.30 | Comparative |
| 303 | EM-R3 | None | Comparative compound 2 | 221 | −0.23 | Comparative |
| 304 | EM-R4 | None | S-5 | 221 | −0.12 | Comparative |
| 305 | EM-R5 | None | S-19 | 242 | −0.13 | Comparative |
| 306 | EM-R6 | $K_4Fe(CN)_6$ | None | 125 | −0.17 | Comparative |
| 307 | EM-R7 | $K_4Fe(CN)_6$ | Comparative compound 1 | 304 | −0.37 | Comparative |
| 308 | EM-R8 | $K_4Fe(CN)_6$ | Comparative compound 2 | 296 | −0.31 | Comparative |
| 309 | EM-R9 | $K_4Fe(CN)_6$ | S-5 | 343 | −0.12 | Invention |
| 310 | EM-R10 | $K_4Fe(CN)_6$ | S-19 | 370 | −0.13 | Invention |
| 311 | EM-R11 | $K_4Fe(CN)_6$ | S-10 | 361 | −0.12 | Invention |
| 312 | EM-R12 | $K_4Fe(CN)_6$ | S-11 | 349 | −0.12 | Invention |
| 313 | EM-R16 | $K_4Fe(CN)_6$ | S-17 | 315 | −0.11 | Invention |
| 314 | EM-R17 | $K_4Fe(CN)_6$ | S-21 | 340 | −0.12 | Invention |
| 315 | EM-R18 | $K_4Fe(CN)_6$ | S-22 | 323 | −0.12 | Invention |
| 316 | EM-R19 | $K_4Fe(CN)_6$ | S-28 | 330 | −0.12 | Invention |
| 317 | EM-R13 | $K_4Ru(CN)_6$ | S-19 | 369 | −0.13 | Invention |
| 318 | EM-R14 | $InCl_3$ | S-19 | 343 | −0.12 | Invention |
| 319 | EM-R15 | $Ga(NO_3)$ | S-19 | 350 | −0.12 | Invention |

From Table 6, it can be understood that the prominent effects of the present invention can be obtained even in the cases of multi-color silver halide photographic light-sensitive material. Super sensitizers of the present invention has extremely high sensitivity when combined with emulsions wherein metal ions are doped on silver halide grains and also has an excellent storage stability.

It can be understood that, of the super sensitizers of the present invention, macrocyclic compounds having an aromatic group ring offer great sensitization effect, and that macrocyclic compounds having 2 aromatic group rings offer so preferable as to offer greater sensitization effect. In addition, in macrocyclic compounds having 2 aromatic group rings, 18-membered ring is preferable because it has a great sensitization effect.

What is claimed is:

1. A silver halide photographic light-sensitive material comprising a support having provided thereon, a silver halide emulsion layer containing silver halide grains and a macrocyclic compound in an amount of $1\times10^{-6}$ to $1\times10^{-1}$ mol per mol of silver, said silver halide grains having a silver chloride content of not less than 90 mol % and containing at least one metal selected from the group consisting of metals of groups VIB, VIIB, VIII, IIB, IIIA, and IVA of the Periodic Table, wherein said macrocyclic compound is a compound represented by Formula (1):

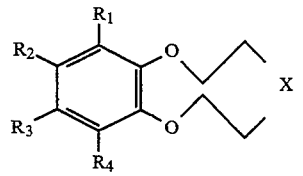

Formula (1)

wherein $R_1$, $R_2$, $R_3$, and $R_4$ independently represent hydrogen, alkyl, alkoxy, aryl, aryloxy, alkenyl, alkenyloxy, acyl amino, halogen, alkylthio, arylthio, alkoxycarbonyl, acyloxy, acyl, or sulfonamido, provided that two of $R_1$ to $R_4$ may combine to form a 5- or 6-membered ring; and X represents a divalent group containing an oxygen atom or a nitrogen atom.

2. The material of claim 1, wherein said silver halide grains have a silver chloride content of not less than 98 mol %.

3. The material of claim 1, wherein said silver halide grains have a silver chloride content of not less than 99 mol %.

4. The material of claim 1, wherein said metals include Fe, Ru, Pd, Re, Os, Ir, Pt, Ga, Ge, In or Tl.

5. The material of claim 1, wherein said silver halide grains contain an iridium compound in an amount of $1\times10^{-11}$ to $5\times10^{-5}$ mol per mol of silver.

6. The material of claim 1, wherein said silver halide emulsion layer further contains in an amount of $2\times10^{-8}$ to $1\times10^{-2}$ mol per mol of silver a red-sensitive sensitizing dye represented by the following Formula (2) or (3):

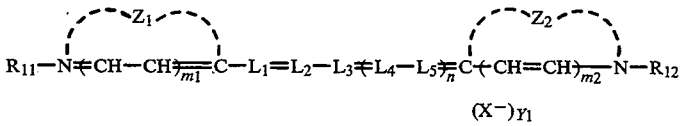

Formula (2)

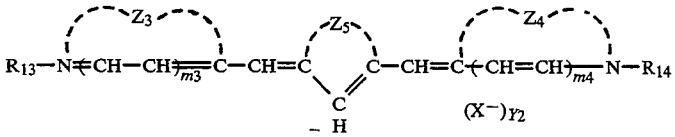

Formula (3)

wherein $R_{11}$, $R_{12}$, $R_{13}$, and $R_{14}$ independently represent an alkyl group, an alkenyl group or an aryl group; $L_1$, $L_2$, $L_3$, $L_4$ and $L_5$ independently represent a methine group; $Z_1$, $Z_2$, $Z_3$, and $Z_4$ independently represent an atomic group necessary to form a 5- or 6-membered heterocyclic ring; $Z_5$ represents an atomic group necessary to form a 6-membered ring; $m_1$, $m_2$, $m_3$, and $m_4$ independently represent 0 or 1; n represents 0 or 1; $X^-$ represents an anion; and $Y_1$ and $Y_2$ independently represent 0 or 1.

7. A silver halide photographic light-sensitive material comprising a support having provided thereon, a silver halide emulsion layer containing silver halide grains, a macrocyclic compound in an amount of $1\times10^{-6}$ to $1\times10^{-1}$ mol per mol of silver, and a red-sensitive sensitizing dye in an amount of $2\times10^{-8}$ to $1\times10^{-2}$ mol per mol of silver, said silver halide grains having a silver chloride content of not less than 90 mol % and containing at least one metal selected from the group consisting of metals of groups VIB, VIIB, VIII, IIB, IIIA, and IVA of the Periodic Table, said macrocyclic compound comprising a compound of Formula (1), and said red-sensitive sensitizing dye being represented by the following Formula (2) or (3):

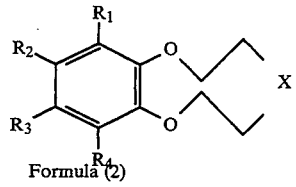

Formula (1)

wherein $R_1$, $R_2$, $R_3$, and $R_4$ independently represent hydrogen, alkyl, alkoxy, aryl, aryloxy, alkenyl, alkenyloxy, acyl amino, halogen, alkylthio, arylthio, alkoxycarbonyl, acyloxy, acyl, or sulfonamido, provided that two of $R_1$ to $R_4$ may combine to form a 5- or 6-membered ring; and X represents a divalent group containing an oxygen atom or a nitrogen atom;

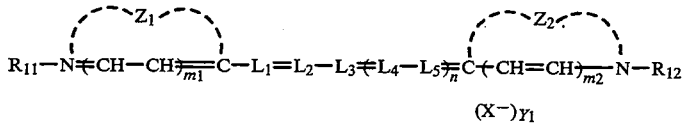

Formula (2)

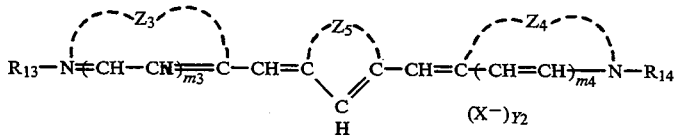

Formula (3)

wherein $R_{11}$, $R_{12}$, $R_{13}$, and $R_{14}$ independently represent an alkyl group, an alkenyl group or an aryl group; $L_1$, $L_2$, $L_3$, $L_4$ and $L_5$ independently represent a methine group; $Z_1$, $Z_2$, $Z_3$, and $Z_4$ independently represent an atomic group necessary to form a 5- or 6-membered heterocyclic ring; $Z_5$ represents an atomic group necessary to form a 6-membered ring; $m_1$, $m_2$, $m_3$, and $m_4$ independently represent 0 or 1; n represents 0 or 1; $X^-$ represents an anion; and $Y_1$ and $Y_2$ independently represent 0 or 1.

* * * * *